US007515124B2

(12) United States Patent
Yaguma et al.

(10) Patent No.: US 7,515,124 B2
(45) Date of Patent: Apr. 7, 2009

(54) ORGANIC EL DRIVE CIRCUIT AND ORGANIC EL DISPLAY DEVICE USING THE SAME ORGANIC EL DRIVE CIRCUIT

(75) Inventors: Hiroshi Yaguma, Kyoto (JP); Masato Kobayashi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 696 days.

(21) Appl. No.: 11/134,312

(22) Filed: May 23, 2005

(65) Prior Publication Data

US 2005/0270256 A1 Dec. 8, 2005

(30) Foreign Application Priority Data

May 24, 2004 (JP) ..... 2004-152749

(51) Int. Cl.
*G09G 3/30* (2006.01)

(52) U.S. Cl. ..... 345/76; 345/36; 345/39; 345/44; 345/45; 345/46; 345/77; 345/82; 345/83; 345/98; 345/204; 315/169.1; 315/169.3

(58) Field of Classification Search ..... 345/36, 345/44–46, 76–83, 105
See application file for complete search history.

(56) References Cited

U.S. PATENT DOCUMENTS 7,098,905 B2 * 8/2006 Abe et al. ..... 345/214
7,292,234 B2 * 11/2007 Kitahara ..... 345/204
7,321,347 B2 * 1/2008 Yaguma et al. ..... 345/76
2004/0090434 A1 5/2004 Miyazawa

FOREIGN PATENT DOCUMENTS

| | | |
|---|---|---|
| CN | 1467695 A | 1/2004 |
| JP | 9-232074 | 9/1997 |
| JP | 2000-276108 | 10/2000 |
| JP | 2004-054238 | 2/2004 |

* cited by examiner

*Primary Examiner*—Richard Hjerpe
*Assistant Examiner*—Jennifer T Nguyen
(74) *Attorney, Agent, or Firm*—Mattingly, Stanger, Malur & Brundidge, P.C.

(57) ABSTRACT

An amplifier circuit for generating a predetermined constant voltage required for resetting organic EL elements or capacitors is provided and an operating current switching circuit switches the operating current of the amplifier circuit to an idling current in a display period and to a steady operation current required to performing a reset operation in a reset period, so that a shifting time of the amplifier circuit from the idling state to the steady operation state can be shortened and a constant control voltage for resetting the organic EL elements or the capacitors can be generated in an initial portion of the reset period.

14 Claims, 2 Drawing Sheets

10
+Vcc
TP3
TP4
OLED
4
7
7a
GND
C
TP1
TP2
3
(DISPLAY CELL)
Y1
Y2
X
< PIXEL CIRCUIT >
ROW SIDE SCAN CIRCUIT
5
WRITE CONTROL CIRCUIT
6a
3a
6n
6i
13
11
1
1n
1i
1a
15
VG
2
xn
Din
S
D
TNn
G1
G2
Dn-1
x2
GND
TNc
Gi
x1
Di
TNb
Do
TNa
RS, WR, etc.
140
VRS
141
op
147
146
xN
TN3
142
143
D/A
TN2
144
TN1
145
VOLTAGE DATA REGISTER
9
14
LP
PR
20
CONTROL CIRCUIT
21
MPU
DISPLAY DATA REGISTER
8
Dn-1
D0 D1
Vb
12
Ir
11a
11b
Va

ORGANIC EL DRIVE CIRCUIT AND ORGANIC EL DISPLAY DEVICE USING THE SAME ORGANIC EL DRIVE CIRCUIT

BACKGROUND OF THE INVENTION

1. Field of the Invention

The present invention relates to an organic EL drive circuit and an organic EL display device using the same organic EL drive circuit. In particular, the present invention relates to an organic EL drive circuit capable of reducing power consumption thereof and capable of shortening a time required to reset capacitors of pixel circuits by reducing power consumption of a reset circuit for resetting constant voltages of the capacitors of the pixel circuits of an active matrix type organic EL display panel, and an organic EL display device using the same organic EL drive circuit.

2. Description of the Related Art

A drive circuit for driving passive matrix type organic EL elements and resetting the organic EL elements by grounding anodes and cathodes of the organic EL elements is disclosed in JPH9-232074A.

On the other hand, a drive circuit of a liquid crystal display device, which drives a data line by a D/A converter circuit, is known. When such drive circuit of the liquid crystal display device is applied to pixel circuits of an active matrix type organic EL display panel, down sizing of the organic EL display panel is difficult. This problem is investigated in JP2000-276108A.

However, when the organic EL drive circuit for driving the active matrix type EL display panel is provided externally of the display panel, the down sizing of the organic EL display panel can be realized. In such case, write of drive current value is performed by charging each of capacitors of pixel circuits, whose capacitance is usually several hundreds pF, with using current in the order of 0.1 μA to 10 μA. However, when luminance of the active matrix type organic EL display panel is to be gradually controlled, highly precise drive current value having minimum current value of about 1 nA to 30 nA is required. There are two types of flowing direction of the drive current, the sink type and the source type. Voltage of a power source line +Vcc is presently about 10V to 20V regardless of the type of the organic EL display panel, the passive matrix type or the active matrix type.

In the sink type current, since voltage for resetting capacitors of pixel circuits of an organic EL display panel is the voltage of the power source line +Vcc or in the vicinity thereof, it is necessary to constitute a D/A converter circuit with organic EL elements having relatively high breakdown voltage. Therefore, an area occupied by each organic EL element becomes large, so that an area occupied by the D/A converter circuits each provided correspondingly to a terminal pin or a column pin of the organic EL display panel is increased considerably.

In order to maintain luminance, a light emitting period of the organic EL element has to be as long as possible and so the reset period of the organic EL element, which corresponds to the retrace period of horizontal scan, should be as short as possible. Therefore, a high operating speed of the reset circuit is required. Moreover, the reset circuit must reset capacitors of pixel circuits for one horizontal display line in a horizontal scan direction or capacitors of a number of pixel circuits, simultaneously. The latter case corresponds to a case where a plurality of column drivers undertake one horizontal display line, in which capacitors of a plurality of pixel circuits corresponding in number to terminal pins or terminal pins for each of R, G and B colors in a case of color display, which are undertaken by each column driver, are reset simultaneously. Therefore, a large amount of drive current is necessary in such reset circuit.

In order to operate the reset circuit, the reset period may be prolonged since it takes a time before the reset circuit enters into a reset operation. In order to avoid such problem, the reset circuit is usually made an operating state even in a display period. As a result, power consumption of the reset circuit increases with increase of the number of capacitors of the pixel circuits or of organic EL elements, which are to be reset simultaneously.

SUMMARY OF THE INVENTION

An object of the present invention is to provide an organic EL drive circuit, which can reduce power consumption of an organic EL circuit by reducing power consumption of a reset circuit and can reset organic EL elements or capacitors of pixel circuits within a short time.

Another object of the present invention is to provide an organic EL display device using the same organic EL drive circuit.

In order to achieve the above mentioned objects, according to the present invention, an organic EL drive circuit for resetting constant voltage of organic EL elements or capacitors of pixel circuits of an organic EL display panel through terminal pins of organic EL display panel in a reset period of a timing control signal having a predetermined frequency and separating a reset period corresponding to a retrace period of horizontal scan from a display period corresponding to scan period for one horizontal scan line is featured by comprising an amplifier circuit for generating a predetermined constant voltage for resetting the organic EL elements or the capacitors, a reset switch provided between an output terminal of the amplifier circuit and a terminal pin and ON/OFF operated by one signal of the timing control signal, a reset control voltage signal similar to the timing control signal, a reset pulse and other pulse generated in the reset period in synchronism with these signals or the reset pulse, and an operating current switching circuit responsive to the one signal for making the operating current of the amplifier circuit to an idling state value in the display period and making the operating current of the amplifier circuit to a value required in a reset operation in the reset period or a period in which either the reset pulse or the other pulse is generated.

In the present invention, the amplifier circuit for generating the predetermined constant voltage for resetting the organic EL elements or the capacitors is provided. The operating current switching circuit sets the operating current of the amplifier circuit to the idling current value in the display period and switches the idling current to a current required for performing the reset operation in the reset period. The current required for the reset operation will be referred to as "steady state current" hereinafter. Thus, a rising time, in which the idling state is switched to the steady operation state, becomes short, so that the constant voltage for resetting the organic EL organic EL elements or the capacitors can be generated in an initial time point of the reset period.

As a result, when the organic EL elements or the capacitors for one horizontal line are reset or one horizontal display line is undertaken by a plurality of column drivers, the resetting of a plurality of organic EL elements or capacitors of pixel circuits, which corresponds in number to terminal pins (terminal pins for R, G and B colors for a color display), undertaken by each column driver can be done simultaneously at high speed. Since only idling current flows in the amplifier circuit in the display period, it is possible to restrict power consumption of the reset circuit to thereby reduce power consumption of the organic EL circuit.

DETAILED DESCRIPTION OF THE PREFERRED EMBODIMENTS

Figure 1:
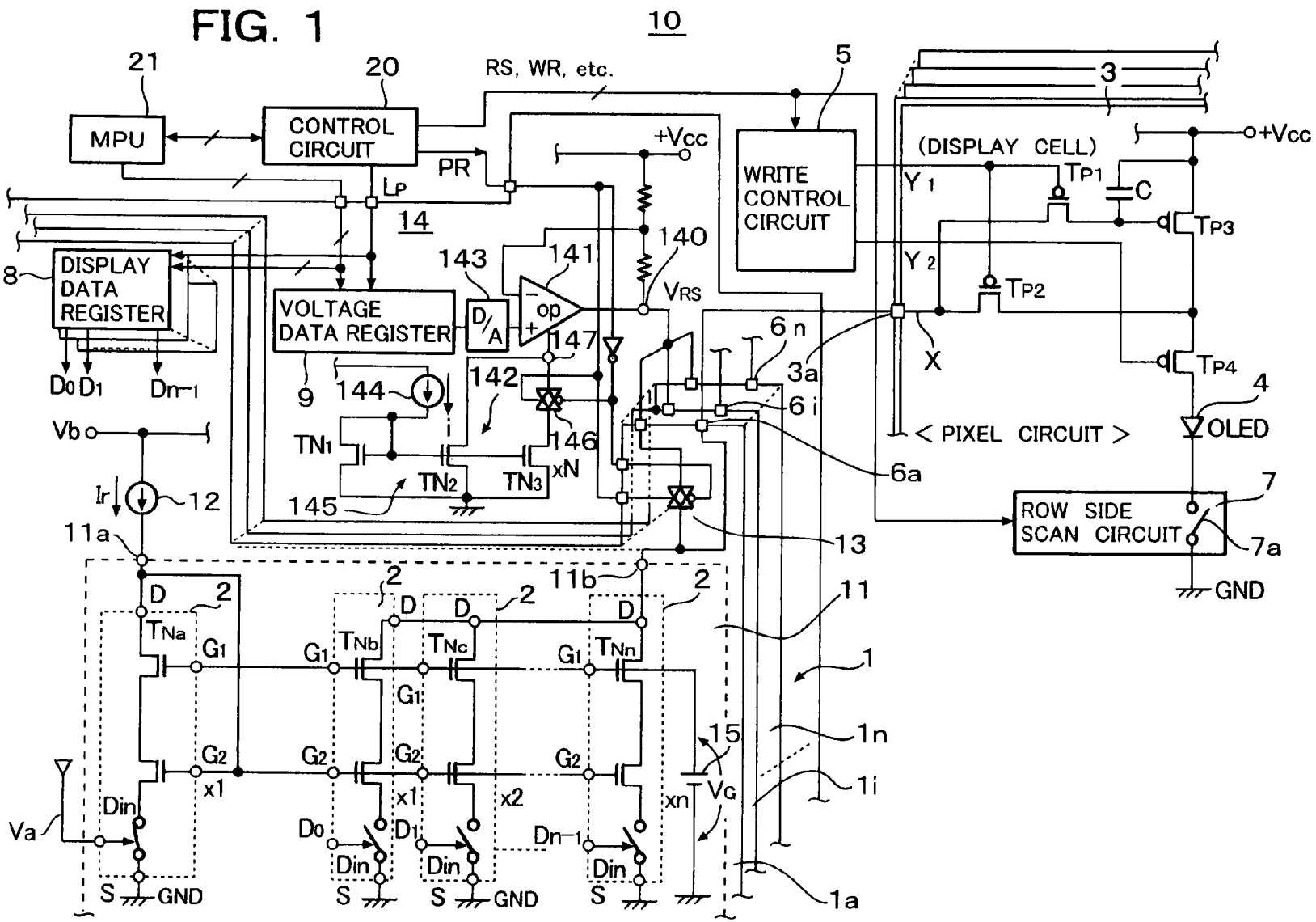
FIG. 1 is a block circuit diagram of an organic EL drive circuit of an active matrix type organic EL display panel, according to an embodiment of the present invention.

In FIG. 1, a reference numeral 10 depicts an active matrix type organic EL display panel. An organic EL drive circuit 1 takes in the form of an integrated circuit driver. The organic EL drive circuit 1 includes current drive circuits 1*a* to in provided correspondingly to data lines of the organic EL display panel. A reference numeral 2 indicates transistor cell circuits. The transistor cell circuits 2 constitute a D/A converter circuit 11.

A reference numeral 3 depicts pixel circuits (display cells), which are matrix-arranged in the organic EL display panel 10, a reference numeral 4 depicts organic EL elements provided in the pixel circuits 3, respectively, and a reference numeral 5 depicts a write control circuit. Reference numerals 6*a* to 6*n* depict output terminals of the current drive circuits 1*a* to 1*n*, respectively. A reference numeral 7 depicts a row side scan circuit and a numeral 7*a* depicts a switch circuit of the row side scan circuit 7. A reference numeral 8 depicts display data registers for storing display data, which are provided correspondingly to the current drive circuits 1*a* to 1*n*, respectively. A reference numeral 9 depicts a voltage data register. A reference numeral 20 depicts a control circuit provided externally of the organic EL drive circuit 1. A reference numeral 21 depicts a MPU, which is provided externally of the organic EL drive circuit IC 1.

The current drive circuits 1*a* to 1*n* provided within the organic EL drive circuit IC 1 are identical in construction. Each current drive circuit includes a D/A converter circuit 11, a constant current source 12 for generating a reference drive current Ir and a reset switch 13. A reset voltage generator circuit 14 of the organic EL drive circuit 1 is provided as a common circuit for the current drive circuits 1*a* to 1*n*.

The constant voltage reset circuit is constructed with the reset voltage generator circuit 14 and the reset switches 13 and operates in response to a precharge pulse PR supplied from the control circuit 20. The reset switches 13 of the current drive circuits 1*a* to 1*n* are constructed with high breakdown voltage analog switches, respectively. Therefore, the D/A converter circuit 11 can be constructed with low breakdown voltage transistors.

Since the current drive circuits are identical in construction and operate similarly, only the current drive circuit 1*a* will be described.

The D/A converter circuit 11 takes in the form of a current mirror circuit constructed with an input side transistor cell circuit TNa and output side transistor cell circuits TNb to TNn.

Each of the output side transistor cell circuits TNb to TNn includes three N channel MOS transistors, which are connected in series and provided between a power source line and a ground line, and has a drain terminal D, gate terminals G1 and G2, an input terminal Din and a source terminal S. Incidentally, a ground side transistor of the three series connected transistors constituting the transistor cell circuit 2 constitutes a switch circuit SW as shown in FIG. 1.

The source terminals S of the transistor cell circuits 2 are commonly grounded. The input terminal Din of the input side transistor cell circuit TNa is connected to a bias line Va to maintain the switch in normally ON state. The input terminals Din of the output side transistor cell circuits TNb to TNn of the D/A converter circuit 11 are supplied with display data D0 to Dn−1 from display data registers 8 provided correspondingly to the respective current drive circuits 1*a* to 1*n*. The switch circuits SW of the output side transistor cell circuits TNb to TNn are ON/OFF controlled according to the display data D0 to Dn−1, respectively. The display data DO to Dn−1 from the MPU 21 are set in the display data registers 8 according to latch pulse LP from the control circuit 20, respectively.

The gate terminals G1 and G2 of each of the transistor cell circuits TNa to TNn are connected commonly and the drain D and the gate terminal G2 of the input side transistor cell circuit TNa are connected to an input terminal 11*a* of the D/A converter circuit 11. Therefore, the center transistor of the three N channel MOS transistor cell circuit TNa is diode-connected and is supplied with the drive current Ir from the constant current source 12 as an input side transistor of the current mirror circuit.

The constant current source 12 is connected to the bias line Vb and acts as an output current source of a reference current distributor circuit. Response to a reference current supplied to the input transistor of the reference current distributor circuit, the latter distributor circuit duplicates reference currents as mirror currents in a plurality of output side transistors provided in parallel correspondingly to the output terminals 6*a* to 6*n* of the organic EL drive circuit (column driver) 1. Thus, the reference currents or reference drive currents are distributed to the output terminal pins (column pins) of the organic EL display panel.

The drain terminals D of the transistor cell circuits TNb to TNn as the output side transistor cell circuits are connected to an output terminal 11*b* of the D/A converter circuit 11. The output terminal 11*b* is connected to an output terminal 6*a* connected to the column pin of the organic EL display panel. The output terminal 6*a* is also connected to an output terminal 140 of the reset voltage generator circuit 14 through the reset switch 13.

Figure 2:
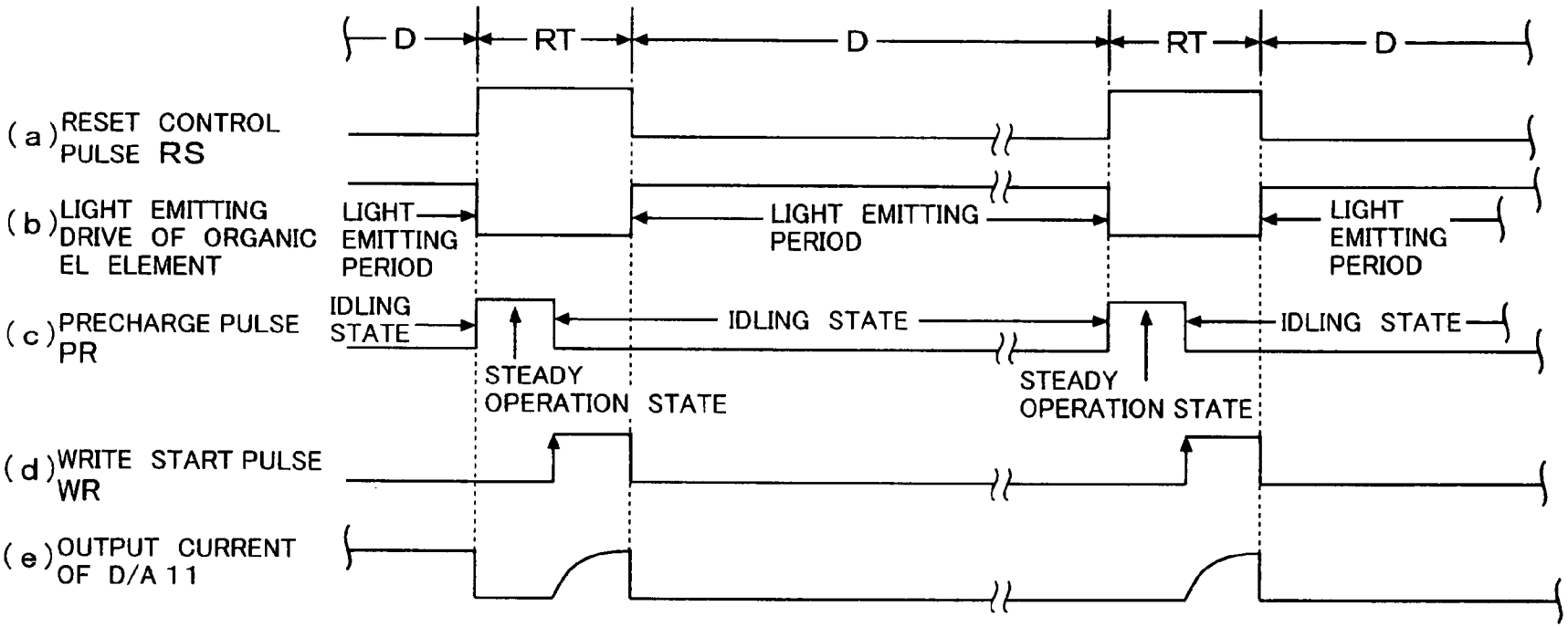
FIG. 2(*a*) to FIG. 2(*e*) show timing charts of the resetting operation.

The reset voltage generator circuit 14 is in the idling state for the display period D of a reset control pulse RS shown in FIG. 2(*a*) and returns from the idling state to the steady operation state in the reset period RT to generate a voltage VRS, which is a constant resetting voltage. Therefore, the reset voltage generator circuit 14 simultaneously resets capacitors, which are connected to the terminals 6*a* to 6*n* of the organic EL drive circuit (column driver) 1 or capacitors corresponding to one horizontal scan line. When the operation of the organic EL drive circuit in the reset period RT is terminated and enters into a next display period D, the reset voltage generator circuit 14 returns to the idling state. Incidentally, the reset control pulse RS corresponds to a timing control signal, which has a predetermined frequency, and divides the display period corresponding to the scan period for one horizontal line and the reset period corresponding to the retrace period of horizontal scan.

Therefore, the reset control pulse RS may be the timing control signal. Since the timing control signal is the reset control pulse RS in the passive matrix type organic EL drive circuit, the operation of the organic EL drive circuit will be described by using not the timing control signal but the reset control pulse RS.

The reset voltage generator circuit 14 is constructed with an operational amplifier 141 as an amplifier circuit, an operating current switching circuit 142 for switching the operating current of the operational amplifier 141, a D/A converter circuit 13 and a constant current source 144.

The operational amplifier 141 is a non-conversion type amplifier driven by power from the power source line +Vcc. The operational amplifier 141 amplifies the output voltage supplied from the D/A converter circuit 143 to a (+) input terminal thereof with a predetermined amplification factor and outputs the amplified voltage to an output terminal 140 as a constant output voltage VRS. The voltage of the power source line +Vcc is in the order of 5V to 20V and the predetermined voltage VRS is lower than the voltage of the power source line +Vcc by several volts. Further, as shown in FIG. 1, a series circuit of a reference resistor and a feedback resistor of the operational amplifier 141 is connected to the power source line +Vcc and its operating reference potential is not ground potential but the voltage of the power source line +Vcc.

The D/A converter circuit 143 receives data, which is set in the voltage data register 9 from the MPU 21 according to the latch pulse LP, and generates an output voltage to be supplied to the (+) input of the operational amplifier 141 by converting the data into an analog data. As a result, the constant output voltage VRS is programmable since the operational amplifier 141 generates the output voltage VRS required for the resetting operation. Incidentally, the MPU 21 sets the reset data in the voltage data register 9 when a power source switch is turned ON. The reset data has been stored in a non-volatile memory in the MPU 21. In the reset period RT of the reset control pulse RS (FIG. 2(*a*)), cathode side of the organic EL element, which is to be reset, is grounded correspondingly to scan of the row side scan line.

The operating current switch circuit 142 responds to a constant current i corresponding to the idling current i, supplied from the constant current source 144 to an input side transistor TN1, which, together with output side transistors TN2 and TN3, constitutes a current mirror circuit to generate the operating current of the operational amplifier 141. The current generated by the operating current switch circuit 142 is the constant current i generated in the output side transistor TN2 of the current mirror circuit in the idling state or a current N×i generated in the output side transistor TN3 of the current mirror circuit in the steady operation state. The operating current switch circuit 142 switches the operating current of the operational amplifier 141 from the current i in the idling state to the current N×i in the steady operation state according to the precharge pulse PR (corresponding to the reset pulse) generated in synchronism with a rising edge of the reset control pulse RS (FIG. 2(*a*)) or switches the steady state current to the idling state current in synchronism with a falling edge of the reset control pulse RS. That is, the operating current of the operational amplifier 141 is the current i in the idling state when the precharge pulse PR is not "H" (high level) and so the operation of the reset voltage generator circuit 14 becomes the idling state.

Incidentally, in the drive state of the active matrix type organic EL display panel, the precharge pulse PR is the reset pulse, which rises with rise of the reset control pulse RS and maintained at "H" for a time period narrower than "H" period of the reset control pulse, as shown in FIG. 2(*c*). In the reset period RT, a write start pulse (or write pulse) WR for writing the drive current in the capacitor C of the pixel circuit 3 is generated at a time when the precharge pulse PR falls as shown in FIG. 2(*d*) and the capacitor C is written with the drive current due to the write start pulse WR. The reset period RT is terminated when the write operation is ended.

Incidentally, in the passive matrix type organic EL display panel, the write of the drive current is unnecessary. Therefore, the reset control pulse RS is used as the reset pulse. In such case, the reset switch 13 becomes ON usually during the reset period RT according to the reset control pulse RS and resets the output terminals through the respective organic EL elements. The reset voltage generator circuit 14 operates by the current N×i in the steady operation state during the reset period RT and, in the display period D, it operates by the current i in the idling period.

The operating current switch circuit 142 is constructed with a current mirror circuit 145 and an analog switch 146. The current mirror circuit 145 is constructed with an input side N channel MOS transistor TN1 and output side transistors TN2 and TN3 and acts as an operating current source of the operational amplifier 141. Further, the current mirror circuit 145 acts as a constant current circuit by the constant current supplied from the constant current source 144 to the input side transistor TN1 thereof. Sources of the transistors constituting the current mirror circuit 145 are grounded. The input side transistor TN1 is diode-connected and is driven by the current i supplied from the constant current source 144 to a drain thereof.

A drain of the output side transistor TN2 is connected to an output terminal 147 of the operating current switch circuit 142 and a drain of the output side transistor TN3 is connected to a current supply terminal 147 of the operating current switch circuit 142 through the analog switch 146. The current output terminal 147 discharges the operating current (ground current) of the operational amplifier 141 to the ground.

The analog switch 146 is turned ON when the precharge pulse PR from the control circuit 20 is changed from "L" (low level) to "H" and maintain the ON state during the "H" period and turned OFF when the precharge pulse PR is changed from "H" to "L". Therefore, it is in OFF state in the write period of the reset period RT and in the display period D.

Channel width (gate width) ratio of the input side transistor TN1 and the output side transistor TN2 is 1:1 and that of the input side transistor TN1 and the output side transistor TN3 is 1:N, where N is an integer equal to or larger than 2. Therefore, the operating current ratio of the input side transistor TN1 and the output side transistor TN3 becomes 1:N. Incidentally, N in this case may be realized by connecting N cell transistors in parallel.

As a result, the operating current of the operational amplifier 141 becomes i in the display period D in which the analog switch 146 is OFF, so that the operational amplifier 141 becomes in the idling state. In the reset period RT (at least in the precharge period) in which the analog switch 146 is ON, the operating current of the operational amplifier 141 becomes (N+1)×i, which flows as the operating current in the steady operation state during the "H" period of the precharge pulse PR.

The above mentioned operation is an example in the case where the reset voltage generator circuit 14 operates with the constant current i corresponding to the idling current i from the constant current source 144. However, the current of the constant current source 144 may be the operating current N×i in the steady operation period. In the latter case, the channel width (gate width) ratio of the input side transistor TN1 and the output side transistor TN3 is made 1:1 and that of the input side transistor TN1 and the output side transistor TN2 is made 1:1/N. Incidentally, the current in the steady operation state becomes (N×i)+i/N.

Therefore, since the operational amplifier 141 operates with the idling current in the display period, power consumption of the operational amplifier 141 is reduced and it can enter into the operating state immediately when the operation enters into the reset period RT.

In FIG. 1, the reset switch 13 for supplying the output voltage VRS to the output terminal 6*a* and the analog switch 146 receives the precharge pulse PR from the control circuit 20 and the reset switch 13 is turned ON when the state of the precharge pulse PR is changed from "L" to "H" and maintained in the ON state for the term of "H" or even in the reset period RT when it receives the reset control pulse RS. When the precharge pulse PR is changed from "H" to "L", the switch 13 is turned OFF and the OFF state is maintained in the display period D.

As such, the operation of the operational amplifier is shifted from the idling state to the steady operation state and enters into the reset period RT at a time when the scan period (display period D) for one horizontal row side scan line is ended, so that the high speed rising from the idling state to the steady operation state of the operational amplifier is achieved. Since the operational amplifier 141 is for the idling state in the display period D, it can operate with only the idling current i, so that power consumption thereof is reduced.

Referring to FIG. 2(*a*) to FIG. 2(*e*), which are timing charts of a resetting operation of the organic EL drive circuit, FIG. 2(*a*) shows the reset control pulse RS (timing control signal) outputted from the control circuit 20 and FIG. 2(*b*) shows a light emitting period of the organic EL element 4, which is determined by the reset control pulse RS. FIG. 2(*c*) shows the precharge pulse PR from the control circuit 20 and FIG. 2(*d*) shows a write start pulse WR supplied from the control circuit 20 to the write control circuit 5 after the voltage resetting according to the precharge pulse PR is ended. A scan line Y1 is set to "L" level by the write control circuit 5 according to the write start pulse WR. This will be described in detail later. FIG. 2(*e*) shows the drive current (sink output current) of the D/A converter circuit 11.

Returning to FIG. 1, the commonly connected gate terminals G1 of the transistor cell circuits TNa to TNn of the D/A converter circuit 11 are connected to a constant voltage bias circuit 15. The upper transistors of the transistor cell circuits 2, which have predetermined resistance values, are set to the ON state by a gate voltage VG set by the constant voltage bias circuit 15. Therefore, it is possible to set voltages at the drain terminals D of the transistor cell circuits TNa to TNn to substantially equal values to thereby improve preciseness of D/A conversion.

As a result, unevenness of the D/A conversion characteristics of the organic EL drive circuit (column driver) 1 is reduced, so that unevenness of output currents at the column pins (or data line terminals) is reduced.

Incidentally, the number of the series connection of the three transistors in the transistor cell circuits 2, which are to be connected in parallel, is indicated by ×1, ×2, . . . ×n, respectively. In a case where the number of the transistor cell circuits 2 is ×1, there is no parallel connection. The outputs of the output side transistor cell circuits TNb to TNn are weighted correspondingly to the numbers of the series connection in the transistor cell circuit, which are to be connected in parallel.

The pixel circuits (display cells) 3 are provided correspondingly to the respective pixels of the organic EL display panel. One of the pixel circuits 3 is connected to the output terminals 6*a* of the current drive circuit 1*a* through a data line X and a connecting terminal 3*a*. The output terminal 6*a* is connected to the output terminal 140 of the reset voltage generator circuit 14 through the output terminal 11*b* of the D/A converter circuit 11 and the reset switch 13. The pixel circuits 3 are arranged at cross points of X and Y matrix wiring lines (the data line X and scan lines Y1, Y2, . . . ), respectively. In the pixel circuit 3, P channel MOS transistors TP1 and TP2, which have gates connected to the scan line X1 and drains connected to the data line X, are arranged. The organic EL element 4 is driven by P channel MOS transistors TP3 and TP4 provided i the pixel circuit 3. A capacitor C is connected between a source and a gate of the transistor TP3.

A source of the transistor TP1 is connected to a gate of the transistor TP3 and a source of the transistor TP2 is connected to a drain of the transistor TP3. When the transistors TP1 and TP2 are turned ON by the write start pulse WR, the gate and the source of the transistor TP3 are diode-connected, so that the drive current (sink current) from the D/A converter circuit 11 flows to the transistor TP3, so that the capacitor C is charged to a voltage corresponding to the drive current precisely.

The source of the transistor TP3 is connected to the power source line +Vcc and the drain thereof is connected to an anode of the organic EL element 4 through the source-drain circuit of the transistor TP4.

In the reset period RT, a cathode of the organic EL element 4, which is to be scanned on the row side, is connected to the switch circuit 7*a* of the row side scan circuit 7 and grounded through the switch circuit 7*a*.

The gates of the transistors TP1 and TP2 are connected to the write control circuit 5 through the scan line (write line) Y1. Therefore, the transistors TP1 and TP2 are turned ON when the gats are scanned by the write control circuit 5 according to the write start pulse WR shown in FIG. 2(*d*). Therefore, the scan line Y1 becomes "L" level. Thus, the predetermined drive current from the D/A converter circuit 11 flows from the power source line +Vcc through the transistor TP3, the capacitor C, transistors TP1 and TP2, the data line X, the terminal 3*a* and the output terminal 6*a*. Thus, the voltage corresponding to the drive current is precisely written in the capacitor C. And then, the scan line Y1 becomes "H" and the transistors TP1 and TP2 are turned OFF.

The gate of the transistor TP4 is connected to the write control circuit 5 through the scan line Y2. The gate is scanned by the write control circuit 5 and the transistor TP4 is turned ON when the scan line Y2 (drive line) becomes "L". The ON states of the transistors TP3 and TP4 are maintained by the falling of the write start pulse WR, so that the drive circuits is supplied to the anode of the organic EL element 4. The potential of this scan line Y2 corresponds to the pulse signal shown in FIG. 2(*b*), which becomes "H" in the light emitting period D. Incidentally, in this case, the scan line Y1 is "H", so that the transistors TP1 and TP2 are in OFF state.

The scan line Y2 becomes "H" at a time when the drive of the transistors TP3 and TP4 is ended, so that the transistor TP4 is turned OFF. With this timing, the scan line Y1 becomes "L". Therefore, the output terminal 140 is set with the output voltage VRS of the reset voltage generator circuit 14 by the transistors TP1 and TP2, which are turned ON thereby, and the reset switch 13, which is turned ON by the precharge pulse PR. Therefore, the voltage of the capacitor C is set to the constant output voltage VRS by the transistor TPa through the output terminal 6*a*.

Incidentally, in this case, the reset switch 13, which is tuned ON by the precharge pulse PR, is provided for each of the current drive circuits 1*a* to 1*n* corresponding to the respective terminal pins of the organic EL display panel 10. Therefore, capacitors C, which are to be reset, are those for one horizontal scan line or corresponding in number to the terminal pins undertaken by a plurality of column drivers when the one horizontal display line is undertaken by the plurality of the column drivers. In a case of color display, the reset voltage generator circuits 14 may be provided correspondingly to respective R, G and B colors. In such case, the number of terminal pins to be reset by each column driver becomes 30 or more.

Although only one switch circuit 7*a* of the row side scan circuit 7 is shown in FIG. 1, a plurality of switch circuits 7*a* are provided and are sequentially ON/OFF controlled correspondingly to the scan of each row side horizontal line. Such row side scan circuit 7 is necessary in the passive matrix type organic EL drive circuit. However, it is possible, in active matrix type organic EL drive circuit, to replace the drive transistor TP4 of the pixel circuit 3 shown in FIG. 1 by a switch circuit 7*a* and remove the switch circuit 7*a* of the row side scan circuit 7. This is because the drive transistor TP4 is provided on the upstream or downstream side of the organic EL element 4 and connected to the organic EL element 4 in series with and the transistor TP4 becomes ON in the display period and OFF in the reset period RT like the operation of the switch circuit 7*a*.

Further, although not shown in FIG. 1, the switch circuit SW of the input side transistor cell circuit TNa of the D/A converter circuit 11 can be turned OFF in the reset period in which the capacitor C is reset. This can be realized by supplying a inverted pulse of the reset control pulse RS to the input terminal Din of the input side transistor cell circuit TNa, which is supplied with the bias voltage Va to make the input terminal "L". Therefore, when the switch circuit SW is turned OFF, the output side transistor cell circuits TNb to TNn are turned OFF. Thus, when the reset switch 13 is turned ON by the reset control pulse RS, the currents flowing in the transistor cell circuits TNb to TNn of the D/A converter circuit 11 are blocked, resulting in reduction of power consumption.

As described hereinbefore, in the described embodiment, the switching from the idling state to the steady operation state is performed by using the start timing of the rest period. However, it is, of course, possible to switch the state with a timing slightly before the start of the reset period RT by considering the start operation of the reset voltage generator circuit 14. In such case, the reset voltage generator circuit 14 becomes the steady operation state steadily at the time when the reset period RT is started.

In the described embodiment, the operation of the operational amplifier is shifted from the idling state to the steady operation state when the reset control pulse RS becomes "H". However, in a case where the operation enters into the reset period RT when the reset control pulse RS is in "L" state, the shift from the idling state to the steady state occurs when the reset control pulse RS becomes "L". "H" and "L" of the reset control pulse RS are logical signals indicative of the operating timing and do not conditions for realizing the shift from the idling state to the steady state. It is enough to switch the state at or before the start of the reset period RT.

In the described embodiment, the resetting of the capacitors of the pixel circuits in the active matrix type organic EL display panel is performed. However, the present invention can be applied to a resetting of terminal voltage of the organic EL element of a passive matrix type organic EL display panel. In such case, the reset voltage generator circuit 14 may generate a constant voltage, which is higher than the ground potential by, for example, several volts.

Further, in the described embodiment, the constant voltage is generated by using the operational amplifier having a predetermined amplification factor. However, instead of the operational amplifier, a general amplifier may be used. For example, a voltage follower amplifier having amplification factor 1 may be used.

Further, the described embodiment, the D/A converter circuits is used as the output stage current source. However, it is possible to additionally provide a current source such as a current mirror circuit as an output stage. In such case, it is possible to drive the output stage current source by an output of the D/A converter circuit. In such case, the pixel circuits or the organic EL elements are driven by a discharge current from the output stage current source.

Further, in the described embodiment, the whole drive circuit is constructed with mainly N channel MOS transistors. However, the circuit may be constructed with P channel MOS transistors or combination of P channel MOS transistors and N channel MOS transistors.

In the described embodiment, MOS transistors are used to constitute the drive circuit. However, instead of the MOS transistors, bipolar transistors can be used therefor.

What is claimed is:

1. An organic EL drive circuit for resetting organic EL elements or capacitors of pixel circuits of an organic EL display panel through terminal pins of said organic EL display panel in a reset period of a timing control signal having a predetermined frequency, for dividing a display period corresponding to a scan period of one horizontal line and the reset period corresponding to a retrace period of the horizontal scan, comprising:

an amplifier circuit for generating a predetermined constant voltage for resetting said organic EL elements or capacitors;

a reset switch provided between an output terminal of said amplifier circuit and one of said terminal pins and ON/OFF operated by one signal of the timing control signal, a reset control signal similar to the timing control signal, a reset pulse and another pulse generated in the reset period in synchronism with one of these signals or the reset pulse; and an operating current switching circuit setting in response to the one signal an operating current of said amplifier circuit to an idling state current in the display period and a reset current required for a reset operation in the reset period or a period in which either the reset pulse or the another pulse is generated.

2. The organic EL drive circuit as claimed in claim 1, wherein said operating current switching circuit includes a constant current circuit for generating the operating current, the current of said constant current circuit being switched between the idling state and a steady operation state, according to the one signal.

3. The organic EL drive circuit as claimed in claim 2, wherein the one signal is changed in level from LOW through HIGH to LOW or from HIGH through LOW to HIGH, and said operating current switching circuit selects one of an idling state current and a steady operation state current with a timing of level change of the one signal from HIGH to LOW or a timing before the level change and the another state with a timing of level change from LOW to HIGH or before the level change.

4. The organic EL drive circuit as claimed in claim 3, wherein said organic EL display panel has a number of said terminal pins, said amplifier circuit is an operational amplifier having an operating current determined by the current of said constant current circuit, a plurality of said reset switches are provided correspondingly to at least a plurality of said terminal pins of the number of said terminal pins, respectively, and a plurality of said reset switches are turned ON simultaneously.

5. The organic EL drive circuit as claimed in claim 4, wherein each said reset switch is provided between said output terminal and each said terminal pin, said constant current circuit includes a current mirror circuit having a plurality of output side transistors as an operating current source of said operational amplifier and a switch circuit provided correspondingly to at least one of the plurality of said output side transistors, and the operating current of said operational amplifier is switched to one of the idling current and the steady operation state current correspondingly to an ON/OFF operation of said switch circuit according to the one signal.

6. The organic EL drive circuit as claimed in claim 5, wherein the one signal is a precharge pulse, one of the plurality of said output side transistors of said current mirror circuit has an operating current ratio 1:N with respect to an input side transistor of said current mirror circuit, where N is 1 or larger, and said switch circuit is connected in series with said one output side transistor and turned ON together with said reset switch according to the precharge pulse.

7. The organic EL drive circuit as claimed in claim 6, further comprising a first D/A converter circuit and a second D/A converter circuit, wherein said first D/A converter circuit, said operational amplifier and said operating current switching circuit constitute a reset voltage generator circuit, said operational amplifier is supplied with a voltage converted by said first D/A converter circuit as an input voltage, said reset voltage generator circuit generates the predetermined constant voltage as a reset voltage for resetting said organic EL elements or said capacitors of said pixel circuits and said second D/A converter circuit is connected to said terminal pins and outputs drive currents to said organic EL elements or said capacitors of said pixel circuits by D/A converting a display data.

8. The organic EL drive circuit as claimed in claim 7, wherein said organic EL display panel is of the active matrix type and said reset voltage generator circuit resets voltages of said capacitors of said pixel circuits.

9. The organic EL drive circuit as claimed in claim 5, wherein the one signal is a precharge pulse, one of the plurality of said output side transistors of said current mirror circuit has an operating current ratio 1:1/N with respect to an input side transistor of said current mirror circuit, where N is 1 or larger, another of said output side transistors has an operating current ratio 1:1 with respect to said input side transistor, and said switch circuit is connected in series with said another output side transistor of said current mirror circuit and turned ON together with said reset switch according to the precharge pulse.

10. The organic EL drive circuit as claimed in claim 7, wherein said organic EL display panel is of the passive matrix type and said reset voltage generator circuit resets terminal voltages of said organic EL elements.

11. An organic EL display device including an organic EL drive circuit for resetting organic EL elements or capacitors of pixel circuits of an organic EL display panel through terminal pins of said organic EL display panel in a reset period of a timing control signal having a predetermined frequency, for dividing a display period corresponding to a scan period of one horizontal line and the rest period corresponding to a retrace period of the horizontal scan, said organic EL drive circuit comprising:

an amplifier circuit for generating a predetermined constant voltage for resetting said organic EL elements or capacitors;

a reset switch provided between an output terminal of said amplifier circuit and one of said terminal pins and ON/OFF operated by one signal of the timing control signal, a reset control signal similar to the timing control signal, a reset pulse and another pulse generated in the reset period in synchronism with one of these signals or the reset pulse; and an operating current switching circuit setting in response to the one signal an operating current of said amplifier circuit to an idling state current in the display period and a reset current required for a reset operation in the reset period or a period in which either the reset pulse or the another pulse is generated.

12. The organic EL display device as claimed in claim 11, wherein said operating current switching circuit includes a constant current circuit for generating the operating current, the current of said constant current circuit being switched between the idling state and a steady operation state, according to the one signal.

13. The organic EL display device as claimed in claim 12, wherein the one signal is changed in level from LOW through HIGH to LOW or from HIGH through LOW to HIGH, and said operating current switching circuit selects one of an idling state current and a steady operation state current with a timing of level change of the one signal from HIGH to LOW or a timing before the level change and the another state with a timing of level change from LOW to HIGH or before the level change.

14. The organic EL drive circuit as claimed in claim 13, wherein said organic EL display panel has a number of said terminal pins, said amplifier circuit is an operational amplifier having an operating current determined by the current of said constant current circuit, a plurality of said reset switches are provided correspondingly to at least a plurality of said terminal pins of the number of said terminal pins, respectively, and a plurality of said reset switches are turned ON simultaneously.

* * * * *